US007344435B2

(12) United States Patent
Pollak et al.

(10) Patent No.: US 7,344,435 B2
(45) Date of Patent: Mar. 18, 2008

(54) HAND-HELD POWER TOOL WITH CLAMPING DEVICE FOR A TOOL

(75) Inventors: Roland Pollak, Runkel (DE); Rolf Ziegler, Sonnenbühl (DE)

(73) Assignee: C. & E. Fein GmbH (DE)

( * ) Notice: Subject to any disclaimer, the term of this patent is extended or adjusted under 35 U.S.C. 154(b) by 0 days.

(21) Appl. No.: 11/552,027

(22) Filed: Oct. 23, 2006

(65) Prior Publication Data

US 2007/0060030 A1 Mar. 15, 2007

Related U.S. Application Data

(63) Continuation of application No. PCT/EP2005/003794, filed on Apr. 12, 2005.

(30) Foreign Application Priority Data

Apr. 23, 2004 (DE) ..... 10 2004 020 982

(51) Int. Cl.
*B24B 23/00* (2006.01)

(52) U.S. Cl. ..... 451/342; 451/358; 83/698.41

(58) Field of Classification Search ..... 451/342, 451/357, 358; 30/388; 83/571, 573, 698.41
See application file for complete search history.

(56) References Cited

U.S. PATENT DOCUMENTS 4,597,227 A * 7/1986 Gentischer et al. ..... 451/342
4,989,374 A * 2/1991 Rudolf et al. ..... 451/342
5,022,188 A * 6/1991 Borst ..... 451/342
5,157,873 A * 10/1992 Rudolf et al. ..... 451/342
5,259,145 A * 11/1993 Fushiya et al. ..... 451/342
5,263,283 A * 11/1993 Rudolf et al. ..... 451/344
5,601,483 A * 2/1997 Rudolf et al. ..... 451/359
5,718,621 A * 2/1998 Turley ..... 451/342
6,511,369 B2 * 1/2003 Chi ..... 451/344
6,780,093 B2 * 8/2004 Krondorfer et al. ..... 451/344

(Continued)

FOREIGN PATENT DOCUMENTS

DE 41 22 320 1/1992

(Continued)

OTHER PUBLICATIONS

International Search Report, dated Aug. 23, 2005, 3 pages.

*Primary Examiner*—M. Rachuba
(74) *Attorney, Agent, or Firm*—St. Onge Steward Johnston & Reens LLC

(57) ABSTRACT

A hand-held power tool (10) is specified, comprising a work spindle (12) for driving a tool (68), said tool (68) being fastenable between a fastening element (38) and a holding portion (36) on a tool end of the work spindle (12), and a displacement device (24) for sliding the fastening element (38) between a released position in which the fastening element (38) can be detached from the work spindle (12) and a clamped position in which the fastening element (38) is clamped against the holding portion (36) by a spring element (48). The fastening element (38) includes a clamping shaft (42) that is insertable into the work spindle (12) and held in the clamped position by a lock assembly (54) inside the work spindle (12), and which can be removed when in the released position (FIG. 2).

20 Claims, 3 Drawing Sheets

U.S. PATENT DOCUMENTS

| | | | | |
|---|---|---|---|---|
| 6,786,811 | B2 * | 9/2004 | Krondorfer et al. | 451/342 |
| 6,860,792 | B2 * | 3/2005 | Krondorfer et al. | 451/8 |
| 6,910,694 | B2 * | 6/2005 | Hartmann et al. | 279/141 |
| 6,953,197 | B2 * | 10/2005 | Hartmann | 279/141 |
| 7,013,987 | B2 * | 3/2006 | Nock et al. | 173/213 |
| 7,128,641 | B1 * | 10/2006 | Lin | 451/359 |
| 2002/0170408 | A1 | 11/2002 | Hartmann et al. | 83/666 |

FOREIGN PATENT DOCUMENTS

| | | |
|---|---|---|
| DE | 41 34 072 | 4/1993 |
| DE | 198 24 387 | 12/1999 |
| EP | 0 152 564 | 8/1985 |
| EP | 0 650 805 | 8/1994 |

* cited by examiner

HAND-HELD POWER TOOL WITH CLAMPING DEVICE FOR A TOOL

CROSS REFERENCES TO RELATED APPLICATIONS

This application is a continuation of International Patent Application PCT/EP2005/003794, filed on Apr. 12, 2005 designating the U.S., which International Patent Application has been published in German language and claims priority of German patent application 10 2004 020 982.0, filed on Apr. 23, 2004, the entire contents of which is incorporated herein by reference.

BACKGROUND OF THE INVENTION

The invention relates to a hand-held power tool comprising a work spindle for driving a tool, said tool being fastenable between a fastening element and a holding portion on a tool end of the work spindle, and a displacement device for sliding the fastening element between a released position in which the fastening element can be detached from the work spindle and a clamped position in which the fastening element is clamped against the holding portion by a spring element.

A hand-held power tool comprising a clamping device for manually clamping a tool is known from EP 0 152 564 B1.

Said known hand-held tool is an angle grinder that includes a hollow drive shaft with a spindle displaceably mounted therein. Said spindle can be displaced by a clamping device between a clamped position and a released position. In the clamped position, a tool such as a grinding disk can be clamped against a fastening portion with the aid of a nut and held in the clamped position under the force of a spring after the clamping device is moved. Since the displacement device in the released position causes the spindle to move against the force of a spring, the nut can be screwed off without the aid of an accessory when in the released position, in order to change the tool.

Although a clamping device of this kind basically enables a tool to be clamped onto the drive shaft of a hand-held tool without the need of an accessory tool, such a clamping device is suitable only for clamping tools that are rotatingly driven. If the tool is driven by an oscillating drive means such that it oscillates back and forth about the longitudinal axis of the work spindle, this results in large abrupt torques in both directions of rotation and with great impetus, with the result that it is not possible with the known clamping device to ensure that the tool is clamped sufficiently securely.

Another hand-held power tool is known from DE 198 24 387 A1 that has an oscillatingly driven work spindle for driving the tool. Said tool can be fastened to the work spindle between a holding portion of the work spindle and a fastening flange which is rigidly connected to a clamping bolt. The clamping bolt can be held on the work spindle by means of a collet-like clamping effect, a retaining ring or O-ring, by magnetic force or by means of a locking mechanism in which a spring impinges upon locking roller members.

Although the various solutions known from this document are essentially suitable for clamping a tool onto a work spindle without using an accessory, it has been found that the clamping forces that can be achieved here are likewise inadequate for many applications.

SUMMARY OF THE INVENTION

It is a first object of the invention to disclose a hand-held power tool that enables a tool to be fastened to the work spindle in a simple and reliable manner without having to use an auxiliary tool such as a spanner or the like.

It is a second object of the invention to disclose a hand-held power tool that enables a tool to be fastened to the work spindle in a simple and reliable manner with a strong clamping force that is sufficient to ensure reliable and secure clamping of the tool even under heavy loads.

It is a third object of the invention to disclose a hand-held power tool that enables a tool to be fastened to the work spindle in a simple and reliable manner with a strong clamping force that is sufficient to ensure reliable and secure clamping of the tool even under oscillating loads such as those which occur in appliances driven by an oscillating drive.

These and other objects are achieved by a hand-held power tool in which the fastening element includes a clamping shaft that is insertable into the work spindle and held in the clamped position by a lock assembly inside the work spindle, and which can be removed when in the released position.

The problem of the invention is completely solved in this manner.

According to the invention, the displacement device enables complete decoupling between application of the clamping force by the spring element, and between the movement of the work spindle. In the clamped position, the spring element with which the clamping force is applied moves in concert with the work spindle, such that a strong clamping force can be applied by appropriately dimensioning the spring element. Since the lock assembly for fixation of the clamping shaft insertable into the work spindle is itself accommodated inside the work spindle, it also enables the displacement device to be completely decoupled from the work spindle such that, when in the clamped position, there is no contact whatsoever between the work spindle and the displacement device. Frictional forces are thus avoided, and any slackening of the clamping force is prevented even under heavy, abrupt and oscillating loads.

In an advantageous development of the invention, form-locking elements are provided on the clamping shaft of the fastening element and on the lock assembly for form-locking fixation of the clamping shaft in the clamped position.

Using form-locking elements ensures even greater security against the clamping tension slackening under heavy loads.

According to a further embodiment of the invention, the lock assembly has radially moveable clamping members.

In this way, strong clamping can be achieved.

According to one development of this embodiment, the lock assembly has a collar against which the clamping members are radially displaceably held.

Said clamping members are preferably biased in the radial direction towards the center by the spring element.

The clamping members, of which preferably three or more are provided at equal angular spacing from each other, are preferably held in recesses in the collar.

In an advantageous development of this embodiment, the clamping members have inclined surfaces on their sides facing the tool, which co-operate with inclined surfaces on the collar in such a way that any movement of the collar against the inclined surfaces of the clamping members causes impingement upon the clamping members towards the center.

These measures enable a clamping force axially applied by a spring element to be converted reliably and robustly, and with simple means, into a radial clamping force for securing the clamping shaft of the fastening element.

It is expedient in this case to bias the collar in the axial direction into the closed position by means of the spring element.

According to another advantageous configuration of the invention, an ejector is provided on the work spindle in the form of a sleeve rigidly attached to the work spindle, said ejector limiting any movement of the clamping members in the axial direction on the tool side.

This measure ensures that the clamping members can be safely opened when the fastening element is to be pulled out of the work spindle into the released position in order to change the tool.

In an appropriate development of the invention, the clamping members are prevented by lugs from falling out of the collar towards the center.

According to another configuration of the invention, the work spindle comprises a spindle tube and a bearing journal that can be fixedly joined to each other and preferably screwed together, and which define a cavity inside which the lock assembly and preferably the spring element are accommodated.

This ensures a compact structure that is protected against adverse external influences.

According to another configuration of the invention, the bearing journal is passed through in the axial direction by a thrust member by means of which the lock assembly can be axially displaced against the force of the spring element.

In this case, the displacement device preferably includes an eccentric that can be operated by a cocking lever and which acts upon an axial end of the thrust member.

These measures enable axial displacement between the clamped position and the released position in a simple and reliable manner.

According to another embodiment of the invention, the eccentric is configured to be self-locking, such that any independent movement of the cocking lever from the released position into the clamped position is prevented.

By this means it is possible to ensure that the displacement device is not moved unintentionally out of the released position into the clamped position under the force of the spring element. Thus, any risk posed by rapid movement out of the released position into the clamped position under the force of the spring element is excluded.

In a preferred developed of the invention, the thrust member is confined by the bearing journal when in the clamped position to an end position in which the displacement device maintains an axial distance from the thrust member.

In this way, frictional forces during operation are avoided, and adverse factors that could lead to a slackening of the clamping force are eliminated.

The thrust member can preferably be screwed together with the collar.

Simple mounting of the clamping members on the collar can be achieved in this manner.

The clamping members are preferably enclosed on the outer surfaces and biased towards the center by a clamping element, preferably in the form of an O-ring or the like.

This ensures that a ratchet connection between the clamping shaft of the fastening element and the clamping members can already be achieved on insertion of the fastening element into the work spindle.

As already mentioned in the foregoing, the work spindle is preferably coupled to an oscillating drive for driving the work spindle in an oscillating manner about its longitudinal axis.

To this end, the work spindle can be connected to a vibration fork that co-operates with an eccentric to drive the work spindle in an oscillating manner.

The spring element should preferably be dimensioned in such a way that a strong clamping force sufficient for all applications ensues. For this purpose, the spring element can be embodied as a torsion spring, a disk spring or some other kind of spring, for example as a rubber spring.

To obtain form-locking fixation of the fastening element in the clamped position, a toothed section that co-operates with matching teeth on the clamping members is provided on the clamping shaft of the fastening element.

Said toothed section preferably has tooth tips extending in the circumferential direction, said tooth tips being of triangular cross-section and having an apex angle greater than 90°.

This ensures that the form-locking connection between the clamping members and the fastening element in the released position can be easily terminated in order to draw the fastening element out of the work spindle.

According to another embodiment of the invention, each clamping member is biased in the direction of the tool by a spring which is braced against the thrust member.

This ensures that the clamping members are correctly positioned.

In an alternative embodiment of the invention, the clamping shaft can be provided with a threaded portion that co-operates with matching threaded portions on the clamping members.

According to another variant of the invention, the clamping shaft has a conical portion that form-lockingly engages with matching clamping members.

It is self-evident that the features of the invention as mentioned above and to be explained below can be applied not only in the combination specified in each case, but also in other combinations or in isolation, without departing from the scope of the invention.

BRIEF DESCRIPTION OF THE DRAWINGS

Additional features and advantages of the invention derive from the following description of preferred embodiments, in which reference is made to the drawings, in which.

DESCRIPTION OF PREFERRED EMBODIMENTS

Figure 1:
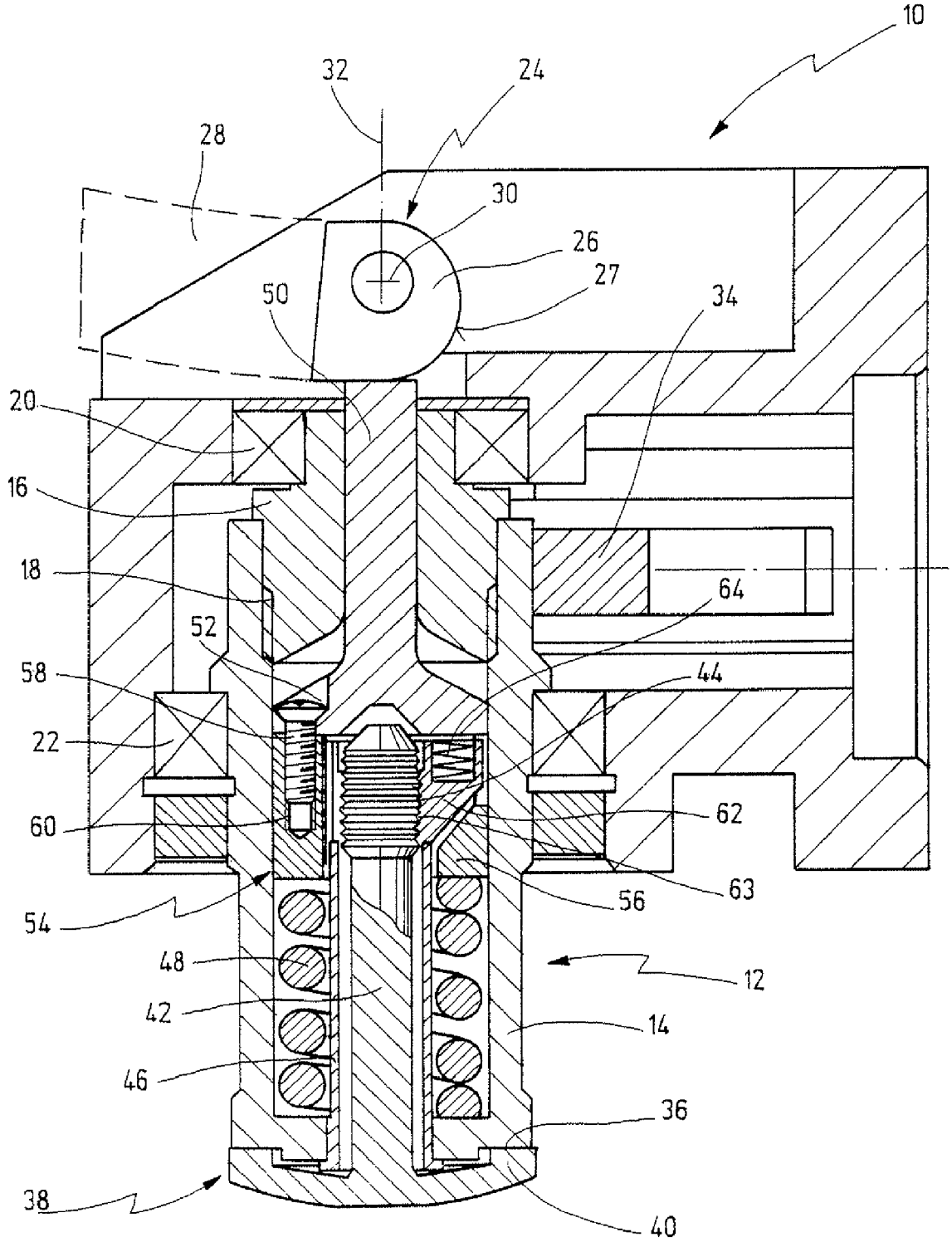
FIG. 1 shows in a cutaway view a hand-held tool according to the invention, comprising an oscillating drive means in the region of the gearhead, with the fastening element in the released position.

FIG. 1 shows the gearhead region of a hand-held power tool according to the invention, said power tool being labeled in its entirety with reference numeral 10. Hand-held tool 10 has an oscillating drive for driving a tool in an oscillating manner with a small pivot angle and high frequency about the longitudinal axis 32 of a work spindle 12. Such oscillating drives are used to perform numerous special kinds of work, including cutting out the panes of a motor vehicle using an oscillatingly driven blade, sawing with oscillatingly driven serrated blades, grinding, and many other kinds of work.

In contrast to rotating work spindles, large abrupt torques in both directions of rotation and with great impetus occur when work spindles are oscillatingly driven. Very strong clamping forces (in a relatively small construction space) and a robust backlash-free mechanism are necessary to ensure that tools are held on the work spindle under all operating conditions.

These requirements are satisfied in the hand-held tool according to the invention by means of a special clamping system, in which fast clamping and releasing of a tool is also made possible, without an auxiliary tool having to be used as an aid.

Figure 2:
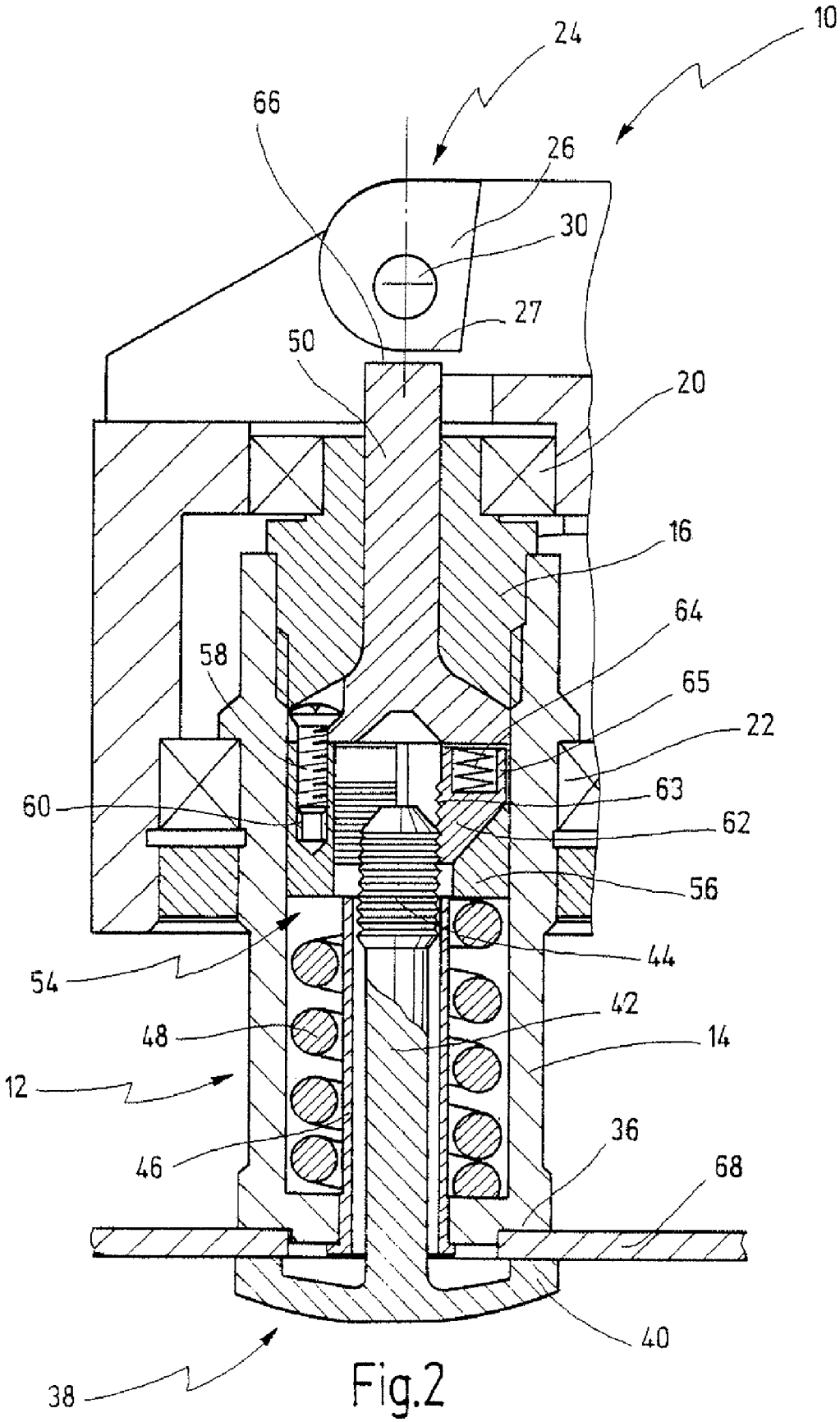
FIG. 2 shows the hand-held tool of FIG. 1 in the clamped position.
Figure 5:
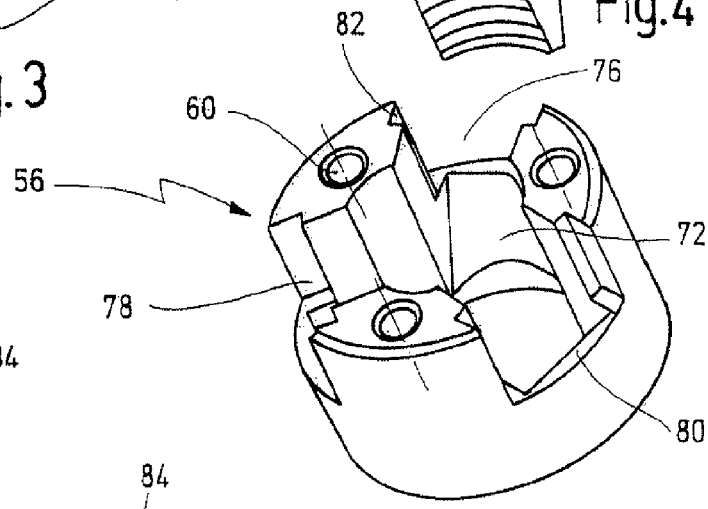
Figure 5:
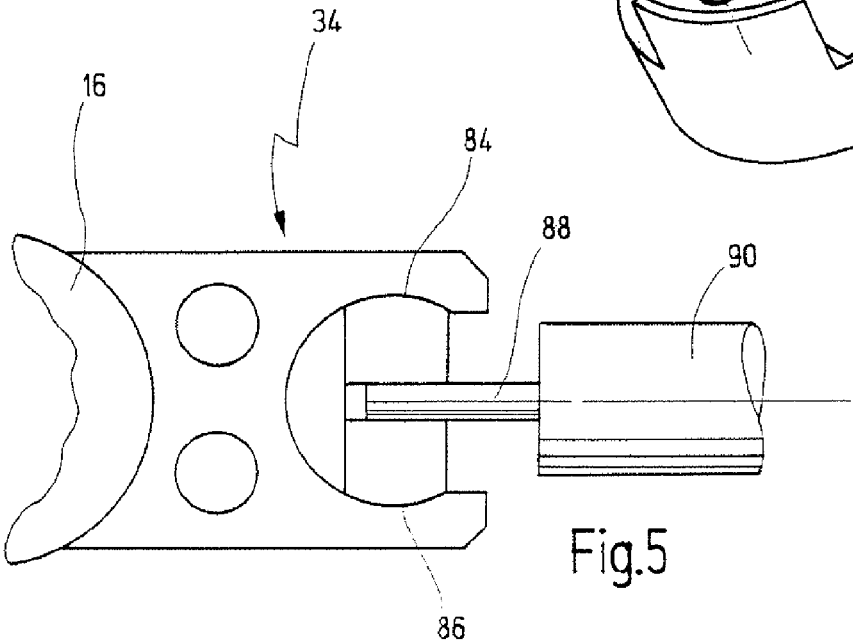

The work spindle 12 shown in FIGS. 1 and 2 is driven oscillatingly about its longitudinal axis 32 by a vibration fork 34. An eccentric 88 is provided for this purpose, as shown in FIG. 5. Said eccentric is enclosed between two sliding surfaces 84, 86 of the vibration fork and is driven by a rotatingly driven drive shaft 90. The rotating drive movement is thus converted into an oscillating movement about the longitudinal axis 32 of work spindle 12, and with a pivot angle of between about 0.5° and 7°, and with a frequency that can be set to about 10000-25000 oscillations per minute.

Work spindle 12 is configured in two parts and includes a substantially pot-shaped spindle tube 14 that can be screwed together with a bearing journal 16 by means of a threaded portion 18. Work spindle 12 is mounted on a bearing 20 via bearing journal 16 and on a bearing 22 via spindle tube 14. A holding portion 36 on the outer end of spindle tube 14, and against which a fastening element 38 can be clamped by means of a flange portion 40, serves to fasten tool 68 (FIG. 2). Fastening element 38 includes a clamping shaft 42, which can be inserted through a central opening in holding portion 36 into work spindle 12 and can be form-lockingly fastened with the aid of a lock assembly labeled in its entirety with reference numeral 54. The clamping force is applied by a spring element 48 in the form of a torsion spring, said spring element being clamped inside spindle tube 14 between holding portion 36 and lock assembly 54 to bias lock assembly 56 in the axial direction away from holding portion 36, so that tool 68 is securely clamped between the holding portion 36 of spindle tube 14 and the flange portion 40 of fastening element 38.

In order to achieve a fast tool change without the aid of an auxiliary tool, lock assembly 54 can be axially displaced by means of a displacement device 24 between a released position as shown in FIG. 1 and a clamped position as shown in FIG. 2. To this end, lock assembly 54 is held between a thrust member 50 and spring element 48 and impinged upon by the force of the spring. In the clamped position, thrust member 50 abuts form-lockingly against a matching recess of bearing journal 16 and protrudes outwardly with its cylindrical shaft through a center bore in bearing journal 16. Displacement device 24 consists of an eccentric 26, which can be pivoted about an eccentric axis 30 by means of cocking lever 28, which is indicated in FIG. 1 by a broken line only. In the clamped position as shown in FIG. 2, there is a gap between the outer front face 66 of thrust member 50 and the opposite pressing surface 27 of eccentric 26. In the clamped position, therefore, thrust member 50 and hence the entire work spindle 12 is decoupled from displacement device 24, so no frictional forces whatsoever can be transferred during operation to work spindle 12. If, in contrast, cocking lever 28 is pivoted forwards from the clamped position shown in FIG. 2 into the released position as shown in FIG. 1, pressing surface 27 of eccentric 26 comes into contact with the front face 66 of the thrust member and displaces thrust member 50 against the force of spring element 48 in the direction of tool 68, as a result of which lock assembly 54 is pushed outwards and releases fastening element 38, as will be described in more detail below.

Figure 4:
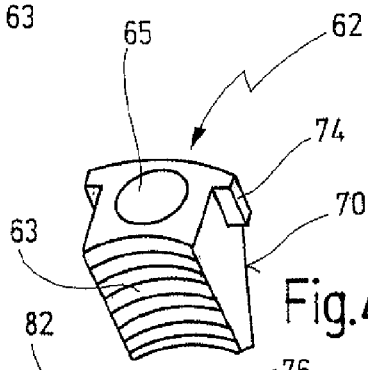
FIG. 4 shows an enlarged exploded view of the collar and a matching clamping part and FIG. 5 shows an enlarged view of the vibration fork of the oscillating drive means, as well as the associated eccentric and drive shaft.

Lock 54 includes a collar 56, the shape of which can be seen in greater detail in FIG. 4. Said collar co-operates with three clamping members 62, of which only one is shown in the Figures. Clamping members 62 are held in matching recesses 76, 78, 80 of collar 56. Clamping members 62 each have, on the side facing the tool 68, an inclined surface 70 that can slide along an inclined surface 72 with the same inclination on collar 56. On their side facing the center, clamping members 62 are each provided with teeth 63 that engage with a matching toothed section 44 on clamping shaft 42 of fastening element 38. In order to prevent clamping members 62 from falling out of collar 56 towards the center when fastening element 38 is pulled out, said clamping members 62 have lateral lugs 74 that engage with matching recesses 82 in collar 56. Each clamping member 62 has an axial bore 65 on its side facing thrust member 50, inside which bore a spring 64 is accommodated that can be in the form of a helical spring and which serve to exert pressure on clamping members 62 in the direction of tool 68. Collar 56 is screwed to thrust member 50 by three screws, one of which can be seen in FIGS. 1 and 2, where it is labeled with reference numeral 58. Screws 58 are screwed through matching bores in thrust member 50 into matching tapped blind holes 60 in the collar. This two-part structure serves for mounting clamping members 62 in the matching openings 76, 78, 80 of collar 56.

The manner in which hand-held tool 10 is operated to clamp or release a tool 68 shall now be described in the following.

In the released position as shown in FIG. 1, cocking lever 28 is tilted forwards (anti-clockwise) as far as its end position, with the result that thrust member 50 is axially displaced a certain amount by pressing surface 27 of eccentric 26. In this position, clamping of a tool between holding portion 36 and flange portion 40 of fastening element 38 is terminated. In this position, clamping members 62 are axially displaced in concert with fastening element 38 in the direction of tool 68 and are held in an end position defined by an ejector 46. Ejector 46 is a cylindrical sleeve that is inserted by a pressure fit or glued into the center opening at the end of spindle tube 14. Ejector 46 limits the axial movement of clamping members 62 in the axial direction on displacement of thrust member 50, when the clamping members contact the front face of ejector 46 with their outer ends, as shown in FIG. 1. When eccentric 26 moves further as far as the end position shown in FIG. 1, a gap ensues between the inclined surfaces 70 and 72 of clamping members 62 and collar 56. When fastening element 38 is then pulled out, clamping members 62 can therefore yield radially outwards, thus releasing the toothed portion 44 of clamping shaft 42. This situation can be seen in greater detail in the enlarged sectional view in FIG. 3. Clamping members 62 are each held by their tool-side end against the front face of ejector 46 and can escape outwardly with their teeth when fastening element 38 is pulled out. The enlarged view in FIG. 3 also shows a clamping element 67 in the form of an O-ring (not shown in FIGS. 1 and 2), which encloses clamping members 62 on their outer surfaces, thus keeping them towards the center with a small biasing force.

Figure 3:
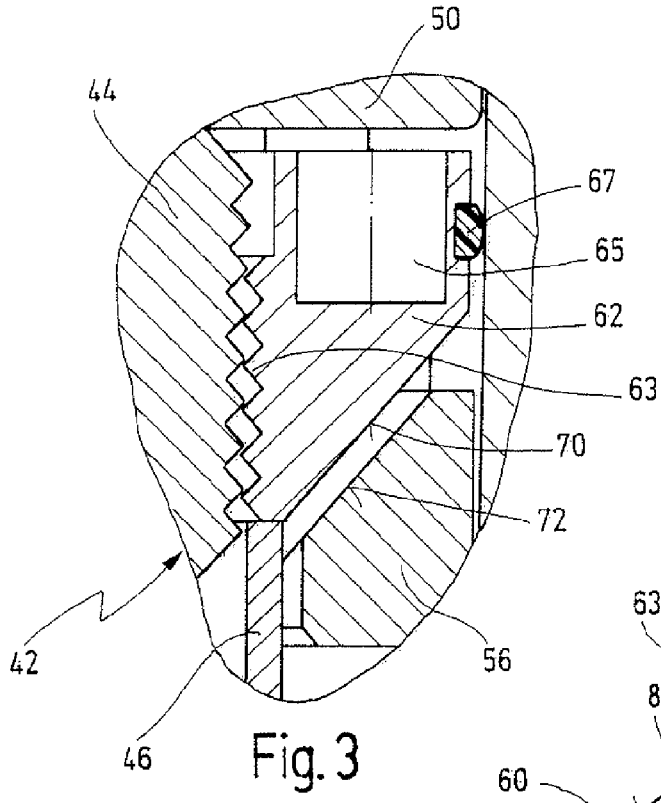
FIG. 3 shows an enlarged section of FIG. 1 in the region of a clamping part.

In the released position as shown in FIG. 1 and FIG. 3, spring 48 is shown in its maximally compressed state. However, since eccentric 26 is configured to be self-locking, cocking lever 28 cannot move back independently from this position to the clamped position.

In this position, fastening element 38 can now be withdrawn, tool 68 replaced and fastening element 38 then re-inserted into work spindle 12. Due to the fastening element and clamping members being intermeshed, ratchet action occurs in the end position. When this happens, clamping members 62 hold toothed portion 44 of fastening element 38 form-lockingly and securely in each ratchet position and exert a biasing force on it. The necessary bias to ensure this ratchet function with step-wise yielding when fastening element 38 is inserted is achieved here by means of clamping element 67 as shown in FIG. 3, which is in the form of an O-ring, for example. This toothed engagement is designed in such a way that the apex angle is greater than 90°, which results in a small operating force being required and in no self-locking occurring. On insertion into work spindle 12, fastening element 38 is therefore able to overcome the small resistance in the form of the biasing force of O-ring 67, with the result that clamping members 62 yield in the radial direction without losing contact with the toothed portion 44 of fastening element 38, and that they are held securely again in each ratchet position.

By turning the cocking lever and the eccentric 26 attached thereto in the clockwise direction, thrust member 50 is subsequently able to move upwards in concert with lock assembly 54 as a result of the spring force of spring element 48. This movement of lock assembly 54 closes the gap between the inclined surfaces 70 of clamping members 62 and the matching inclined surfaces 72 of collar 56. Hence, clamping members 62 are pressed inwards by collar 56 against the toothed portion 44 and engage form-lockingly with the latter. Clamping members 62 enclose fastening element 38 and clamp it radially with a strong force, whereby fastening element 38 is simultaneously pulled inwards in the direction of thrust member 50 and tool 68 is pressed securely against holding portion 36 of spindle tube 14, as shown in FIG. 2.

When displacement device 24 is located in the clamped position, then a gap exists—as already mentioned—between the pressing surface 27 of eccentric 26 and the front face 66 of thrust member 50. As a result, thrust member 50 is mechanically decoupled from displacement device 24. It is not possible for lock assembly 54 to be opened under load, due to the geometrical conditions. Of course, fastening element 38 could theoretically be pulled outwards with such force that the force with which tool 68 is clamped against holding portion 36 is less than the force that must be applied. However, this is prevented by a spring 48 of suitable strength. Even instances of brief overloading would have no consequences, since only the clamping force on tool 68, but not that on lock assembly 54 would be slackened.

When eccentric 26 is in the clamped position shown in FIG. 2, then regardless of whether fastening element 38 is inserted into work spindle 12 or not, a gap between the pressing surface 27 of eccentric 26 and the front face 66 of thrust member 50 is ensured. This "decoupling" in the closed clamping system is therefore independent of whether fastening element 38 is inserted or not.

The toothed portion 44 of clamping shaft 42 and the matching teeth 63 of clamping members 62 can be configured as a grooved profile with uniform pitch. It is also possible, of course, to select a grooved profile with variable pitch and variable apex angles. In addition, toothed portion 44 could also be embodied as a threaded portion, and the matching teeth 63 on clamping members 62 could be correspondingly configured.

Furthermore, it is also possible to use only a clamping shaft 42 with a smooth surface instead of a clamping shaft 42 with a toothed portion 44, if necessary in combination with hard-metal or diamond-coated clamping surfaces on the clamping members to increase the frictional engagement, or for micromeshing.

Finally, a slightly conical clamping shaft 42 could be used, which would result in a kind of infinitely variable and interlocking connection if the clamping surfaces of clamping members 62 are correspondingly shaped.

What is claimed is:

1. A hand-held power tool comprising:

a work spindle for driving a tool, said work spindle having a tool end comprising a holding portion;

a fastener for fastening said tool to said work spindle against said holding portion, said fastener including a clamping shaft being insertable into said work spindle;

a displacement assembly comprising a thrust member configured for sliding said fastener between a released position in which said fastener can be detached from said work spindle and a clamped position in which said fastener is clamped against said holding portion by a claming force; and a lock assembly received inside said work spindle between said thrust member and said fastener for locking said clamping shaft against retraction in said clamped position and for releasing said clamping shaft allowing retraction from said work spindle in said released position;

wherein said lock assembly comprises a collar and a plurality of clamping members held by said collar radially displaceably against said clamping shaft and axially displaceably within said work spindle;

wherein said clamping members comprise first inclined surfaces, said first inclined surfaces engaging second inclined surfaces provided on said collar upon movement of said collar against said first inclined surfaces, thereby impinging said clamping members towards said clamping shaft for engaging said clamping shaft in said clamped position.

2. The hand-held power tool of claim 1, further comprising first form-locking elements provided on said clamping shaft and second form-locking provided on said clamping members for engaging said clamping shaft form-lockingly in said clamped position.

3. A hand-held power tool comprising:

a work spindle for driving a tool, said work spindle having a tool end comprising a holding portion;

a fastener for fastening said tool to said work spindle against said holding portion, said fastener including a clamping shaft being insertable into said work spindle;

a displacement assembly comprising a thrust member configured for sliding said fastener between a released position in which said fastener can be detached from said work spindle and a clamped position in which said fastener is clamped against said holding portion by a claming force; and a lock assembly received inside said work spindle between said thrust member and said fastener for locking said clamping shaft against retraction in said clamped position and for releasing said clamping shaft allowing retraction from said work spindle in said released position;

wherein said lock assembly comprises a collar and a plurality of clamping members held by said collar axially displaceably within said work spindle radially displaceably against said clamping shaft for engaging said clamping shaft in said clamped position.

4. The hand-held tool of claim 3, wherein said clamping shaft comprises first form-locking elements; and wherein said clamping members comprise second form-locking elements co-operating with said first form-locking elements for form-lockingly securing said clamping shaft in said clamped position.

5. The hand-held tool of claim 3, further comprising a spring element for biasing said clamping members in radial direction towards said clamping shaft.

6. The hand-held tool of claim 3, wherein said clamping members comprise first inclined surfaces, said first inclined surfaces engaging second inclined surfaces provided on said collar upon movement of said collar against said first inclined surfaces, thereby impinging said clamping members towards said clamping shaft for engaging said clamping shaft in said clamped position.

7. The hand-held tool of claim 3, further comprising a spring element for biasing said collar in an axial direction towards said clamped position.

8. The hand-held tool of claim 3, further comprising an ejector configured as a sleeve rigidly attached to said work spindle, said ejector limiting movement of said clamping members in axial direction towards the tool.

9. The hand-held tool of claim 3, wherein said collar further comprises lugs configured for preventing said clamping members from falling out towards a longitudinal axis of said work spindle.

10. A hand-held power tool comprising:

a work spindle for driving a tool, said work spindle having a tool end comprising a holding portion;

a fastener for fastening said tool to said work spindle against said holding portion, said fastener including a clamping shaft being insertable into said work spindle;

a displacement assembly comprising a thrust member configured for sliding said fastener between a released position in which said fastener can be detached from said work spindle and a clamped position in which said fastener is clamped against said holding portion by a claming force; and a lock assembly received inside said work spindle between said thrust member and said fastener for locking said clamping shaft against retraction in said clamped position and for releasing said clamping shaft allowing retraction from said work spindle in said released position;

wherein said lock assembly comprises clamping members that are arranged axially displaceably within said work spindle and radially moveably against said clamping shaft for engaging said clamping shaft in said clamped position;

wherein said lock assembly further comprises a collar against which said clamping members are held radially displaceably; and wherein said work spindle further comprises a spindle tube and a bearing journal that can be fixedly joined to each other, and which commonly define a cavity inside which said lock assembly and a spring element for biasing said fastener are accommodated.

11. The hand-held tool of claim 10, wherein said bearing journal is passed through in axial direction by a thrust member by means of which said lock assembly can be axially displaced against a force of said spring element.

12. The hand-held tool of claim 11, wherein said displacement assembly comprises an eccentric and a cocking lever for operating said eccentric, said eccentric engaging an axial end of said thrust member.

13. The hand-held tool of claim 11, wherein said thrust member is confined by said bearing journal, when in the clamped position, to an end position in which said displacement assembly maintains an axial distance from said thrust member.

14. The hand-held tool of claim 11, wherein said thrust member is fixed to said collar.

15. The hand-held tool of claim 3, wherein said clamping members are enclosed on their outer surfaces and biased towards a longitudinal axis of said spindle by a clamping element engaging the outer surfaces of said clamping members.

16. The hand-held tool of claim 1, further comprising an oscillating drive for oscillatingly driving said work spindle about a longitudinal axis thereof.

17. The hand-held tool of one of claim 2, wherein said clamping shaft comprises a section selected from the group formed by a toothed section and a threaded section, said section forming said first form-locking elements, and wherein said clamping members comprise matching teeth forming said second form-locking elements co-operating with said section.

18. The hand-held tool of claim 3, further comprising a plurality of spring elements for biasing said clamping members towards said tool.

19. The hand-held tool of claim 3, wherein said clamping shaft further comprises a conical portion that form-lockingly engages with said clamping members.

20. The hand-held tool of claim 1, wherein said work spindle further comprises a spindle tube and a bearing journal that can be fixedly joined to each other, and which commonly define a cavity inside which said lock assembly and a spring element for biasing said fastener are accommodated.

* * * * *